United States Patent [19]

Cyvas

[11] 4,187,887

[45] Feb. 12, 1980

[54] LOOM PROJECTILE

[75] Inventor: Petras Cyvas, Worcester, Mass.

[73] Assignee: Crompton & Knowles Corporation, New York, N.Y.

[21] Appl. No.: 960,344

[22] Filed: Nov. 13, 1978

[51] Int. Cl.[2] ..... D03J 5/06

[52] U.S. Cl. ..... 139/196.2; 139/196.3

[58] Field of Search ..... 139/196.2, 196.3, 224 R, 139/436, 437, 438, 439

[56] References Cited

U.S. PATENT DOCUMENTS

| | | | |
|---|---|---|---|
| 3,195,580 | 7/1965 | Fend et al. | 139/224 R |
| 3,831,640 | 8/1974 | Wueger | 139/196.2 |
| 4,046,174 | 9/1977 | Weuger | 139/439 |
| 4,095,620 | 6/1978 | Sepavich et al. | 139/196.2 |

FOREIGN PATENT DOCUMENTS

| | | | |
|---|---|---|---|
| 2254974 | 7/1974 | Fed. Rep. of Germany | 139/196.3 |
| 1237034 | 6/1960 | France | 139/436 |
| 1033060 | 6/1966 | United Kingdom | 139/437 |
| 1081404 | 8/1967 | United Kingdom | 139/437 |
| 1098802 | 1/1968 | United Kingdom | 139/439 |

*Primary Examiner*—Henry Jaudon

[57] ABSTRACT

A projectile for use in an outside filling supply loom, comprising an elongated body having an inlet opening at one end and an outlet opening at the opposite end. A flat filling storage chamber is located within the body and is connected to the inlet opening. A passageway located between the storage chamber and outer surface of the body is connected to the outlet opening and the storage chamber.

16 Claims, 9 Drawing Figures

LOOM PROJECTILE

BACKGROUND OF THE INVENTION

This invention relates generally to a projectile for the insertion of filling yarns in a loom, wherein the filling yarn is supplied from supply packages located outside of the loom. The invention is particularly directed to a projectile of the type in which at least a portion of the filing yarn is stored in a filling storage chamber within the projectile. This type of projectile and the loom with which it is used, is shown in U.S. Pat. No. 3,831,640 to Karl W. Wueger, dated Aug. 27, 1974. The projectile disclosed in that U.S. patent is designed for firing alternately from opposite sides of the loom. Because of this, the projectile is provided with a filling storage chamber at each end thereof and means are provided to allow air to pass from one end of the projectile to the other. This flow of air is instrumental in depositing the filling yarn in the storage chamber prior to propulsion of the projectile through the warp shed of the loom for a filling insertion.

The invention is particularly directed to the class of projectiles in which at least a portion of a filling pick is inserted by use of air. Accordingly, the projectiles are designed to permit air to flow through the storage chamber from an inlet opening to allow the filling yarn entering the inlet opening to be carried by this air flow and be deposited within the chamber. The position of the filling in the storage chamber represents no particular problem, but the manner in which the filling is deposited is critical for the withdrawal of the filling as the projectile passes through the warp shed. If the filling is deposited in a random manner, snarls are likely to occur as the filling is withdrawn. In addition, it is important that the filling be withdrawn smoothly and evenly. Another problem sometimes encountered is that the means which permits air to flow through the chamber for depositing filling within the chamber also causes a reverse air flow during the projectile flight, thus causing the filling yarn stored in the chamber to be blown out of the trailing end of the projectile prematurely and thereby to deposit the filling in a bunch or snarl within the warp shed. This produces a defective pick and defective cloth. Occasionally, difficulties have also been encountered in loading the filling into the projectile. As the filling is deposited in the storage chamber, it tends to settle against the outlet openings of the chamber and to block these openings. This reduces air flow through the projectile and interferes with the proper deposit of additional filling yarn.

Many of the above problems have been overcome by the projectile design of my prior U.S. Pat. No. 4,095,620 issued jointly with Victor F. Sepavich on June 20, 1978 and entitled "PROJECTILE FOR WEFT INSERTION". The projectile in this patent provides an air passageway which connects the storage chamber to the outlet opening of the projectile. The air communication between the chamber and passageway extends along the entire length of the passageway so that, as the yarn is deposited within the chamber, a portion of this connection is blocked, but there always remains some communication between the chamber and passageway. In addition, the communication between the storage chamber and passageway is lateral to the traveling axis of the projectile, so that there is no direct effect on the filling within the chamber from the air entering the projectile through the leading end of the projectile. However, one of the problems encountered with the projectile of my U.S. patent, supra, and the Wueger patent, supra, is in the withdrawal of filling from the projectile during its flight through the warp shed. Due to the cylindrical design of the storage filling chamber, the filling is deposited within the chamber in circular loops. Ocasionally, air turbulence interferes with the proper disposition of the loops. Because of this, there is a tendency for subsequently-formed loops to form within previously-formed loops. This may result in snarling or tangling as the filling is withdrawn. In this regard, it is highly desirable that the filling be deposited within the chamber progressively from the inner extremity of the chamber toward the inlet opening, so that as each length of filling is withdrawn, it does not interfere with filling deposited previously.

It is a principle object of the present invention to provide a loom projectile which includes a filling storage chamber in which filling is deposited in a manner which permits the filling to be withdrawn evenly and smoothly from the projectile without causing snarls or twists.

Another object of the invention is the provision of a loom projectile in which the stored filling cannot be blown out of the filling storage chamber prematurely during its flight through the warp shed.

A further object of the present invention is the provision of a loom projectile having a filling storage chamber in which the filling yarn is deposited within the chamber in uniform lengths progressively from the interior of the chamber toward the inlet opening to permit smooth and even withdrawal of the filling.

SUMMARY OF THE INVENTION

In general, the invention consists of a projectile for use in an outside filling supply loom, comprising an elongated body having an inlet opening at one end and an outlet opening at the opposite end. A generally flat filling storage chamber is located within the projectile body along its central longitudinal axis and a passageway is located between the storage chamber and the outside surface of the body. The storage chamber is connected to the inlet opening and to the passageway by perforations extending through a wall which separates the filling storage chamber and the passageway. The passageway is connected to the outlet opening, thereby permitting air flow from the inlet opening to the outlet opening.

More specifically, the filling storage chamber of the projectile comprises a generally flat tube located within a hollow tubular cylindrical body. The broad dimension of the flat tube extends across the entire interior width of the tubular body and the passageway is formed between the broad surfaces of the flat tube and the inner annular surface of the tubular body. In the preferred embodiment, the projectile has a filling storage chamber at each end thereof which is separated by a perforated wall. Each filling storage chamber is generally tapered toward this dividing wall. In the preferred embodiment, the inlet opening of one chamber functions as the outlet opening of the other chamber. Each inlet opening is circular and has a diameter which is equal to the narrow dimension of the chamber. The projectile is provided with guide surfaces which extend from the inlet opening to the narrow sides of the chamber, so that there is a continuous surface from the inlet opening to the filling storage chamber.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
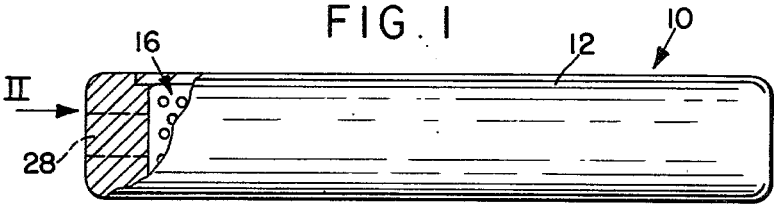
FIG. 1 is a plan view of the projectile of the present invention with portions broken away.
Figure 2:
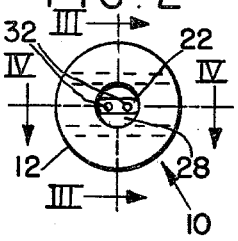
FIG. 2 is an end view of the projectile looking in the direction of arrow II in FIG. 1.

The drawings illustrate a loom projectile made in accordance with the principles of the present invention. The projectile shown in FIGS. 1–6 represents the preferred embodiment of the invention. The projectile shown in these figures is designed for picking from opposite ends of the loom alternately and is therefore symmetrical in every respect.

Referring particularly to FIGS. 1–4, the projectile is generally indicated by the reference numeral 10 and comprises a hollow, elongated cylindrical outer body 12 having an inner annular surface 14. A perforated flat, tubular member 16 is located centrally within the main body 12 and is divided into a pair of filling storage chambers 18 and 20 by means of a central partition 22. The outer ends of chambers 18 and 20 have openings 24, 26, respectively, which communicate with inlet openings 28 and 30, respectively, at the outer ends of body 12. Partition 22 serves as an end wall for both filling storage chambers 18 and 20 and contains a plurality of perforations 32 which provide air passageways between the two chambers.

Figure 5:
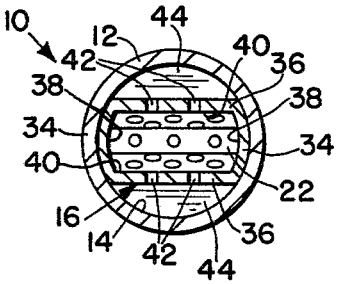
FIG. 5 is a vertical sectional view taken along the line V—V of FIG. 3.
Figure 6:
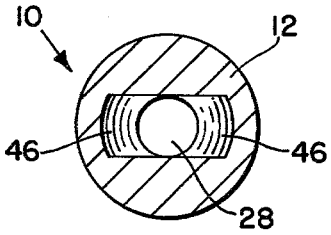
FIG. 6 is a vertical sectional view taken along line VI—VI of FIG. 3.

Referring particularly to FIG. 5, the cross-section of tubular member 16 is generally rectangular, comprising two narrow sides 34 abutting opposite sides of annular surface 14 of the outer body and two broad sides 36 connecting the narrow sides 34. Narrow sides 34 have inner narrow surfaces 38, which define therebetween the broad dimension of the filling storage chamber and the broad sides 36 have inner surfaces 40 which define therebetween the narrow dimension of the filling storage chamber. The broad sides 36 contain a plurality of apertures 42 which connect the filling storage chambers to passageways 44 located between the inner surface 14 of the outer body and broad sides 36 of the tubular member 16. The outer body 12 forms the outer wall of passageways 44 and the tubular member 16 forms the inner wall of the passageway. Narrow sides 34 may be cemented or bonded to surface 14 to maintain tubular member 16 in position.

Figure 3:
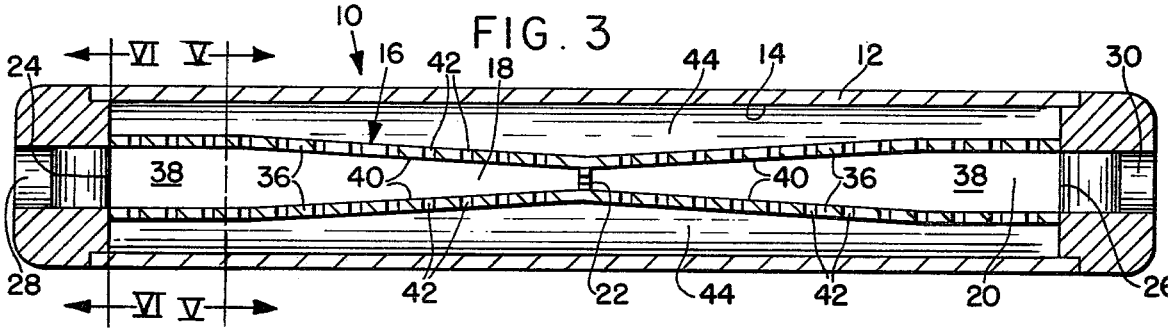
FIG. 3 is a vertical sectional view taken along line III—III of FIG. 2.
Figure 4:
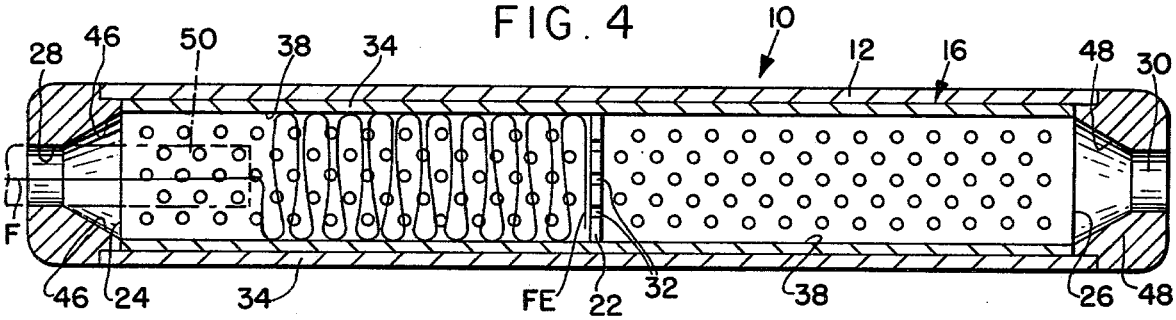
FIG. 4 is a horizontal sectional view taken along line IV—IV of FIG. 2.

Referring particularly to FIG. 3, the broad surfaces 40 of each filling storage chamber are generally parallel from the outer opening of the chamber inwardly for a first distance and thereafter are generally convergent toward partition 22. The narrow dimension of the chambers 18 and 20 adjacent their outer openings 24, 26, respectively, are equal to the diameters of inlet openings 28 and 30, respectively, while the narrow dimensions of the chambers are considerably less adjacent the partition 22. As seen in FIG. 4, the broad dimensions of the filling storage chambers are considerably greater than the diameters of the inlet openings 28 and 30 throughout the length of the chambers. The inner portions of the inlet openings 28 and 30 are enlarged in the broad plane of the filling storage chambers, the enlarged portions being formed by surfaces 46 and 48, respectively, see also FIG. 6. Surfaces 46 and 48 diverge from the outer circular portions of inlet openings 28 and 30 to the generally rectangular openings 24 and 26, respectively, of the filling storage chambers, thereby providing a continuous air passageway between the inlet openings and their respective filling storage chambers.

The operation of the apparatus will now be readily understood in view of the above description. Referring to FIG. 4, it is assumed that the projectile is located at the left-hand side of the loom prior to being picked to the right-hand side. Filling yarn, indicated at F, is introduced into the left-hand filling storage chamber 18 by means of an air nozzle 50 shown in dot and dash lines in FIG. 4. Nozzle 50 forms part of the weft insertion apparatus of the loom. The free end of the filling, indicated at FE, is blown into the chamber by a blast of air through the air nozzle 50. The air stream carries the end of the filling down to the end of the chamber against the partition 22. Apertures 32 in the partition enable air to esacpe through the partition and insures that the filling is carried to the inner end of the chamber. Because of the flat shape of the storage chamber, the filling is deposited in long loops which extend across the broad dimension of the chamber and fold along its narrow dimension alternately from one side to the other, shown graphically in FIG. 4. As the filling is deposited within the chamber, the accumulation of loops creates a progressive build-up of yarn from partition 22 to opening 24. The apertures 42 allow the air to escape from the chamber into the passageways 44 into chamber 20 through its apertures 42 and out of the projectile through opening 30 which functions as an outlet opening for storage chamber 18 when filling is deposited into chamber 18. Likewise, opening 28 functions as the outlet opening for chamber 20 when filling is deposited in chamber 20 during the subsequent picking cycle when the projectile is located at the right-hand side of the loom. As the projectile is propelled across the loom during the next picking sequence, from left to right as viewed in FIGS. 3 and 4, the filling in chamber 18 is not subjected to a direct blast of air from opening 30. Therefore, the filling will not be accidentally blown out of the chamber, as is the case with certain prior art projectiles. In addition, as the projectile proceeds through the warp shed during its flight towards the right-hand side of the loom, the filling yarn is withdrawn from the storage chamber loop by loop, progressively from the left-hand side of the chamber toward the right in the reverse order that the loops were deposited. This provides an even, smooth withdrawal of filling from the chamber which enables the filling to be deposited within the warp shed evenly and without snarls. The insertion of filling in the warp shed represents a critical phase of the weaving operation and the improvement in this phase provided by the projectile of the present invention contributes greatly to the quality of the cloth produced by the loom.

FIRST MODIFIED PROJECTILE

Figure 7:
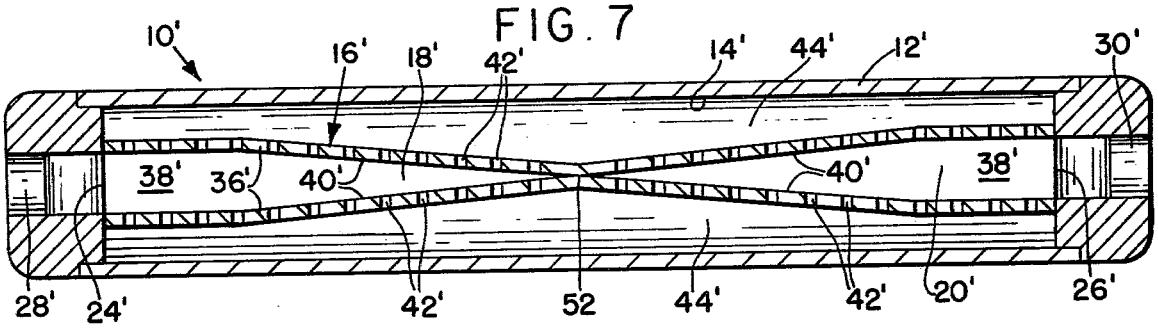
FIG. 7 is a view similar to FIG. 3 showing a first modification.

Referring to FIG. 7, there is shown a first modified projectile generally indicated by the reference numeral 10'. This projectile is identical to the preferred projectile shown in FIGS. 1-6, except that there is no perforated partition separating the two chambers. The various elements of the projectile are identified with the same reference numerals as for the preferred embodiment with the addition of primes. In this first modification, the broad sides 36' of each chamber 38' converge toward the center of the projectile, so that their inner surfaces 40' come together at the center of the projectile. The filling storage chamber shown in the first modification is preferably made by flattening an apertured cylindrical tube so that its cross-sectional shape is the same as the cross-section of tube 16 shown in FIG. 5 for the entire length of the tube. The broad sides of the tube 16' are squeezed together in the center as at 52 to form the two chambers 18' and 20', shown in FIG. 7. After the tube 16' has been shaped in the above-described manner, it is placed within the main body 12' and bonded in place. The main body 12' is shown as a single continuous structure for clarity. However, it is to be understood that the main body 12' is fabricated by applying the end portions containing inlet openings 28' and 30' to an open-ended cylindrical tube after the tube 16 has been positioned therein. The ends are thereafter bonded to the main cylindrical portion to form the final structure illustrated in FIG. 7.

SECOND MODIFIED PROJECTILE

Figure 8:
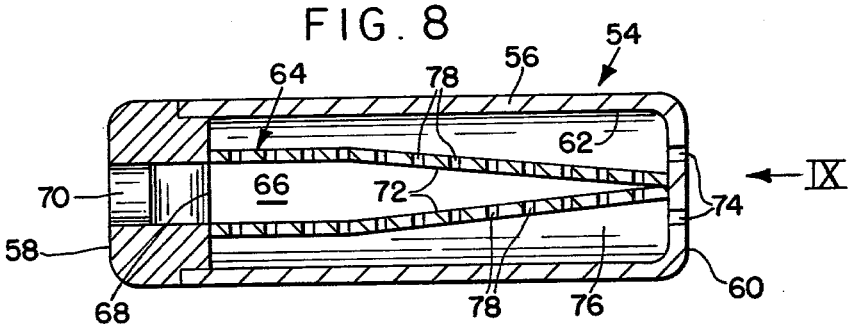
FIG. 8 is a view similar to FIG. 3 showing a second modification.
Figure 9:
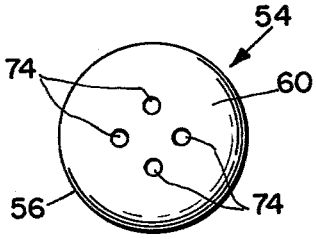
FIG. 9 is an end view looking in the direction of arrow IX in FIG. 8.

Referring particularly to FIGS. 8 and 9, there is shown a modified projectile generally indicated by the reference numeral 54. This modified projectile incorporates the inventive concepts of the present invention and is designed for use in a loom where filling picks are inserted from only one side of the loom. In looms of this type, the projectile is picked from one side, boxed on the opposite side and then conveyed back to the side where it was picked. Because of this, several projectiles are used during the course of weaving.

Projectile 54 has an elongated cylindrical body 56 with generally rounded ends 58 and 60. Body 56 is tubular and has an annular inner surface 62. A perforated flat tubular member 64 is located centrally within the main body 56. The space within the tube forms a filling storage chamber 66, identical in shape to the chamber 18' shown in FIG. 7. One end of the chamber 66 has an opening 68 which communicates with an inlet opening 70 in the end 58 of the outer body 56. The broad sides of the tube 64, indicated at 72, extend from opening 68 for the same distance as in the preferred embodiment and thereafter converge toward the end 60 of the main body. Outlet openings 74 extend through end 60 into an annular passageway 76 formed between the tubular member 64 and the inner surface 62 of the main body. Apertures 78 in tubular member 64 connect the chamber 66 to the passageway 76. Filling is introduced into the chamber 66 in the same manner as described for filling storage chamber 18 in the preferred embodiment.

Filling yarn is pneumatically inserted within storage chamber 66 through inlet opening 70 by a jet of air and this air is allowed to escape from chamber 66 into passageway 76, through apertures 78 and out of the projectile through apertures 74. One or more openings 74 may be employed as the outlet opening for the projectile. After filling yarn has been introduced into chamber 66, the projectile 54 is picked to the right, as viewed in FIG. 8. During its flight through the warp shed, air enters openings 74 into passageway 76, through apertures 78 into chamber 66, and finally passes out through the projectile to the inlet opening 70.

It is obvious that minor changes may be made in the form and construction of the invention without departing from the material spirit thereof. It is not, however, desired to confine the invention to the exact form herein shown and described, but it is desired to include all such as properly come within the scope claimed.

I claim:

1. A projectile for use in a loom in which filling picks are inserted from an outside supply source, the projectile comprising:
   (a) an elongated body having an inlet opening at one end and outlet opening at the opposite end thereof,
   (b) an outer wall defining the outer shape of the body,
   (c) a perforated inner wall defining a generally flat filling storage chamber within the body, said storage chamber being connected to the inlet opening, and
   (d) a passageway located between the inner and outer walls, said passageway being connected to the outlet opening and to the storage chamber by the perforations in the inner wall.

2. A projectile as set forth in claim 1, wherein the perforations connecting the chamber and passageway are uniformly distributed along the inner wall.

3. A projectile as set forth in claim 1, wherein the outer wall is a cylindrical tube having an inner annular surface and the inner wall is a flat tube having a pair of narrow sides which abut opposite sides of the inner surface of the tube and a pair of spaced broad sides which connect the narrow sides to form said storage chamber therebetween, said passageway being located between at least one of the long sides and the inner surface of the tube.

4. A projectile as set forth in claim 3, wherein one end of the flattened tube is open and is connected to the inlet opening and the opposite end of the flat tube is closed.

5. A projectile as set forth in claim 4, wherein the distance between the long sides of the flat tube is substantially greater at the open end than at the closed end.

6. A projectile as set forth in claim 4, wherein a substantial portion of the long sides of the perforated tube adjacent the closed end coverge toward the closed end.

7. A projectile as set forth in claim 4, wherein the inlet opening is circular and has a diameter which is substantially equal to the narrow dimension of the open end of the tube, the projectile having guide surfaces which extend from the inlet opening to the narrow sides of the flat tube.

8. A projectile as set forth in claim 1, wherein the flat filling storage chamber has a pair of opposite narrow surfaces which define therebetween the broad dimension of the chamber and a pair of spaced broad surfaces connecting the narrow surfaces and defining therebetween the narrow dimension of the chamber, the narrow dimension of the chamber being substantially greater at the end adjacent the inlet opening than at the opposite end of the chamber.

9. A projectile as set forth in claim 8, wherein the broad surfaces of the chamber are parallel for a first distance extending from the inlet opening and convergent toward the opposite end of the chamber for the remaining distance.

10. A projectile as set forth in claim 9, wherein the inlet opening is circular and has a diameter which is equal to the narrow dimension of the chamber adjacent the inlet opening, said projectile having guide surfaces which extend from the inlet opening to the narrow surfaces of the storage chamber.

11. A projectile for use in a loom in which filling picks are inserted from an outside supply source comprising:

(a) an elongated body, (b) a central generally flat cavity extending along the central longitudinal axis of the body and including an inlet opening at each end of the body, (c) means at the center of the cavity for dividing the cavity into two filling storage chambers, (d) a passageway located between the cavity and the outer surface of the body, and (e) a plurality of apertures connecting each of the storage chambers with the passageway.

12. A projectile as set forth in claim 11, wherein the means for dividing the cavity into the filling storage chambers comprises a partition having at least one aperture connecting the two filling storage chambers.

13. A projectile as set forth in claim 11, wherein the transverse configuration of each filling storage chamber comprises a narrow dimension and a relatively broad dimension and wherein the narrow dimension of the chamber is greater adjacent the inlet opening then at the opposite end of the chamber.

14. A projectile as set forth in claim 13, wherein each inlet opening is circular and has a diameter which is equal to the narrow dimension of the filling storage chamber adjacent the inlet opening, said projectile having guide surfaces which extend from each inlet opening to the limits of the broad dimension of the adjacent filling storage chamber.

15. A projectile as set forth in claim 13, wherein narrow dimension of each filling storage chamber is uniform for a first distance extending from the inlet opening and tapers toward the dividing means for the two chambers.

16. A projectile as set forth in claim 11, wherein the apertures are uniformly distributed between the cavity and passageway.

* * * * *